United States Patent [19]

Berges et al.

[11] Patent Number: 4,940,398

[45] Date of Patent: Jul. 10, 1990

[54] TWIN-SHAFT, MULTIPLE-STAGE VACUUM PUMP WITH THE SHAFTS VERTICALLY DISPOSED

[75] Inventors: Hanns-Peter Berges; Hartmut Kriehn, both of Cologne; Wolfgang Leier, Bergisch Gladbach; Ralf Steffens, Cologne, all of Fed. Rep. of Germany

[73] Assignee: Leybold Aktiengesellschaft, Cologne, Fed. Rep. of Germany

[21] Appl. No.: 193,659

[22] Filed: May 13, 1988

[30] Foreign Application Priority Data

May 15, 1987 [EP] European Pat. Off. ..... 87107089.2

[51] Int. Cl.[5] ..... F04C 29/00

[52] U.S. Cl. ..... 417/410; 418/88

[58] Field of Search ..... 417/410, 244; 418/9, 418/206, 88

[56] References Cited

U.S. PATENT DOCUMENTS

| | | | |
|---|---|---|---|
| Re. 25,567 | 5/1964 | Lorenz | 230/139 |
| 1,446,366 | 2/1923 | Young . | |
| 1,623,650 | 4/1927 | Anderson . | |
| 2,549,652 | 4/1951 | Wilhelm | 418/206 |
| 2,880,676 | 4/1959 | Succop | 417/410 |
| 3,472,445 | 10/1969 | Brown | 418/189 |
| 3,558,248 | 1/1971 | Parker | 418/88 |
| 3,628,898 | 12/1971 | Bragdon | 418/45 |
| 3,677,664 | 7/1972 | Wycliffe et al. | 418/9 X |
| 3,796,526 | 3/1974 | Cawley | 418/97 |
| 3,811,805 | 5/1974 | Moody, Jr. et al. | 418/88 |
| 4,504,201 | 3/1985 | Wycliffe | 418/9 X |
| 4,639,199 | 1/1987 | Frings et al. | 418/9 X |
| 4,728,271 | 3/1988 | Harwarth | 418/206 X |
| 4,767,284 | 8/1988 | Shiinoki et al. | 417/410 X |

FOREIGN PATENT DOCUMENTS

| | | | |
|---|---|---|---|
| 3147824 | 5/1982 | Fed. Rep. of Germany . | |
| 1290239 | 2/1961 | France . | |
| 1248032 | 9/1971 | United Kingdom . | |
| 1301475 | 12/1972 | United Kingdom | 418/9 |

OTHER PUBLICATIONS

Patent Abstracts of Japan, "Enclosed Screw Compressor," 52-106618, vol. 3, No. 65 (M-61), Jun. 6, 1979.

*Primary Examiner*—Leonard E. Smith
*Assistant Examiner*—Robert N. Blackmon
*Attorney, Agent, or Firm*—Spencer & Frank

[57] ABSTRACT

A twin-shaft vacuum pump having a pair of shafts, at least one pump chamber, a pair of rotors disposed in the or in each pump chamber and mounted on the shafts, and housing members defining the pump chamber or chambers, a synchronization mechanism composed of two gears disposed in a side chamber, a drive motor, and a transmission mechanism connecting the drive motor to one of the shafts. In order to simplify installation and servicing of the pump, the shafts are mounted vertically. The side chamber, synchronization mechanism, and transmission mechanism are disposed below the lower rotor pair.

19 Claims, 3 Drawing Sheets

TWIN-SHAFT, MULTIPLE-STAGE VACUUM PUMP WITH THE SHAFTS VERTICALLY DISPOSED

BACKGROUND OF THE INVENTION

The present invention relates to a twin-shaft vacuum pump of the type having at least one pump chamber and a pair of rotors disposed in the or each pump chamber, plates defining the pump chamber or chambers, and a synchronization mechanism disposed in a side chamber and composed of two gears, with one end of one of the shafts being in communication with a drive motor.

DE-OS (German published, un-examined application) No. 3,147,824 discloses a twin-shaft vacuum pump of this type. In its operating position, the pump shafts are disposed horizontally so that, particularly if the pump is constructed to have several stages, a relatively large structural length results. In other words, such a pump covers a relatively large amount of floor space. Moreover, installation and servicing are difficult, since such work must usually be performed with the pump in the operating position.

SUMMARY OF THE INVENTION

The present invention is directed primarily to a twin-shaft vacuum pump of the above-mentioned type in which all rotor pairs are preferably rotary pistons of the claw type (Northey profile). However, the present invention can also be used with twin-shaft vacuum pumps equipped with rotors of different configuration (Roots profile, screw profile, or any desired combination of all mentioned profiles).

It is an object of the present invention to provide a twin-shaft vacuum pump of the above-mentioned type which is relatively compact, takes up a small amount of floor space, and is relatively easy to install or service.

This is accomplished according to the invention in that the shafts of the vacuum pump are arranged vertically and the side chamber containing the synchronization mechanism and the means for connecting one of the rotors with the drive motor are disposed below the lower rotor pair. A twin-shaft vacuum pump constructed in this manner requires a relatively small amount of floor space. Moreover, due to the vertical arrangement of the shafts, installation and servicing work can easily be performed. If the pump is cooled with water, a complete cooling water discharge is particularly simple.

In an embodiment of the twin-shaft vacuum pump, the pump inlet is disposed above the uppermost pump stage and is configured as a vertical connecting pipe with a horizontal connecting flange. Moreover, the pump outlet is disposed below the lowermost pump stage. An embodiment of this type has the advantage that it can be combined in a simple manner with vertically conveying Roots pumps. Furthermore, due to the vertically arranged shafts, condensation within the pump stages flows downwardly and out of the pump outlet, so that no condensation damage will occur during prolonged operation. A separate gas ballast input can be omitted. Finally, the pump may be rinsed out to remove annoying deposits or coatings by introducing a rinsing fluid into the inlet. Without special measures, the rinsing fluid leaves through the pump outlet due to gravitational forces. This is particularly applicable for vacuum pumps having rotary pistons of the claw type (Northey profile). In pumps of this type, the inlet and outlet openings are disposed at the frontal faces in the side plates or members so that the discharge of liquids out of the connecting channels is also ensured. Finally, a Roots pump connected upstream can be included in the rinsing process.

DESCRIPTION OF THE PREFERRED EMBODIMENTS

Figure 1:
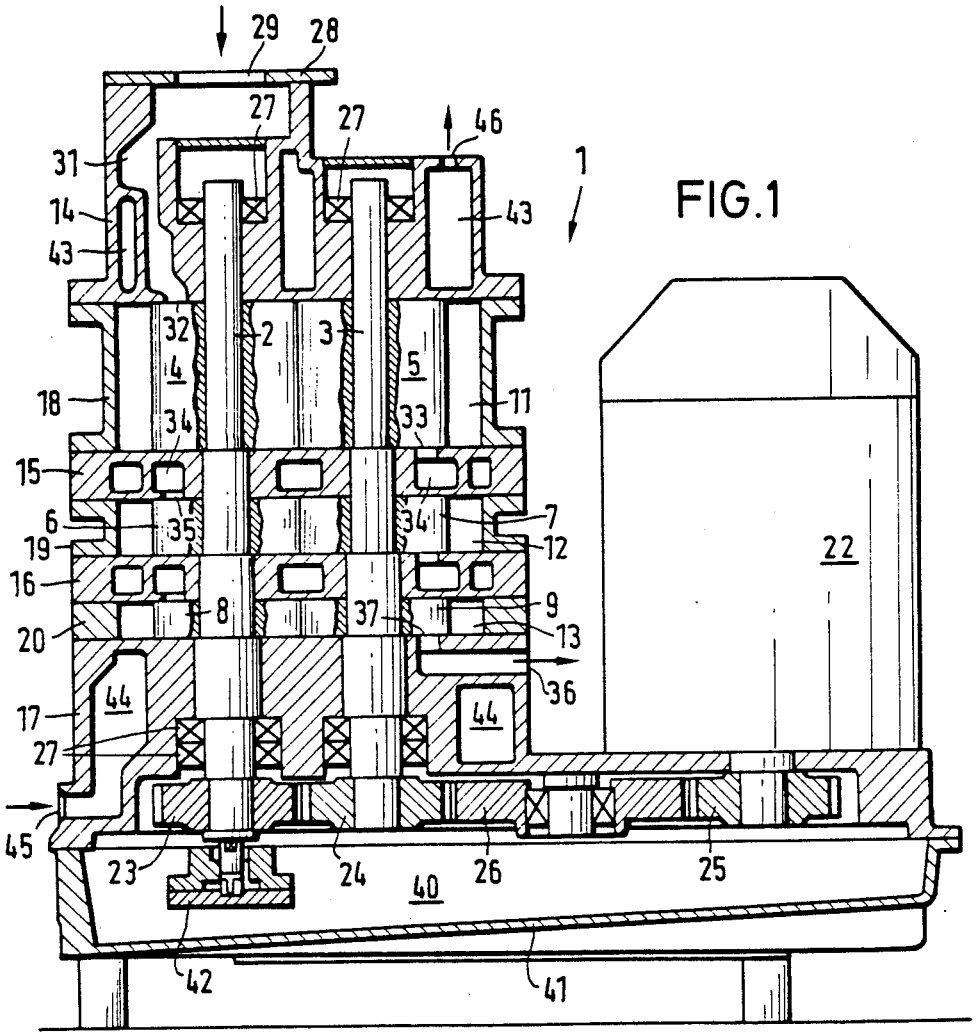
FIG. 1 is a longitudinal sectional view of a multistage pump according to one embodiment of the invention, and shows the pump housing beside a drive motor.
Figure 2:
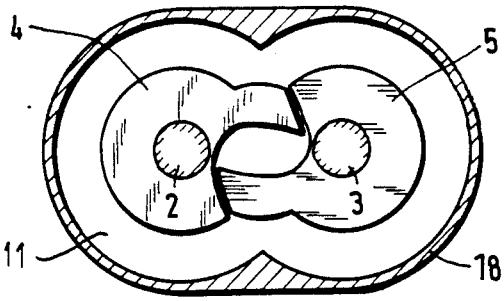
FIG. 2 is a sectional view of a pair of rotors.

The embodiment shown in FIG. 1 involves a three-stage vacuum pump 1 having two shafts 2 and 3 and three rotor pairs 4 and 5, 6 and 7, as well as 8 and 9. The axial length (that is, height) of the rotors decreases from the suction side of pump 1 (at the top of the pump) to the pressure side. Pump 1 has a housing which includes channel members 14 through 17 and housing rings 18 through 20. Rotors 3 and 4 are cooperating rotary pistons of the claw type (see FIG. 2) and rotate in a pump chamber 11 in housing ring 18. Rotor pair 6 and 7 and rotor pair 8 and 9 are also rotary pistons of the claw type. Rotors 6 and 7 are disposed in a pump chamber 12 provided by housing ring 19, and rotors 8 and 9 are disposed in a pump chamber 13 in housing ring 20. Pump chambers 12 and 13 have the same configuration as the pump chamber 11 shown in FIG. 2.

Shafts 2 and 3 are arranged vertically. This also applies for the shaft of the drive motor 22, which is arranged next to the pump housing. Gears 23 and 24, both having the same diameter and serving to synchronize the movement of rotor pairs 4 and 5, 6 and 7, and 8 and 9, are attached to shafts 2 and 3 below lower channel member 17. A gear 25 is attached to the shaft of motor 22. The driving connection is established by a further gear 26 which meshes with gears 24 and 25.

Shafts 2 and 3 are supported by way of roller bearings 27 in upper channel member 14 and in lower channel member 17. Upper channel member 14 is equipped with a horizontally disposed connecting flange 28 which forms the inlet 29 for the pump 1. Inlet channel 31 leads to an inlet port 32 for the pump chamber 11 of the first stage. The outlet port 33 for the first stage leads into a connecting channel 34 in channel member 15. The connecting channel 34 communicates with the inlet port 35 of the second stage. Channel member 16 is configured correspondingly. Below the lowermost (third) pump stage, there is disposed an outlet 36 which is communication with the outlet port 37 of pump chamber 13.

Below the system composed of the pump housing and the motor, there is provided a chamber 40 containing oil. It is formed by a common shaft trough 41. An oil pump 42 connected with shaft 2 projects into chamber 40. Lubricant channels (not shown in detail) extend from the oil pump 42 to the parts of the pump (bearings, locations where gears 23 to 26 mesh, shaft seals or the like) which require lubrication.

Pump 1 is water cooled. For this purpose, cooling water channels 43 and 44 are provided in channel members 14 and 17, and channels 43 and 44 are connected by external tubing (not illustrated). Reference numbers 45 and 46 identify a cooling water inlet and outlet, respectively. Cooling water inlet 45 is disposed at the lowermost location of channel system 43, 44 so that simple cooling water discharge is possible and complete drainage of the system is ensured.

Figure 3:
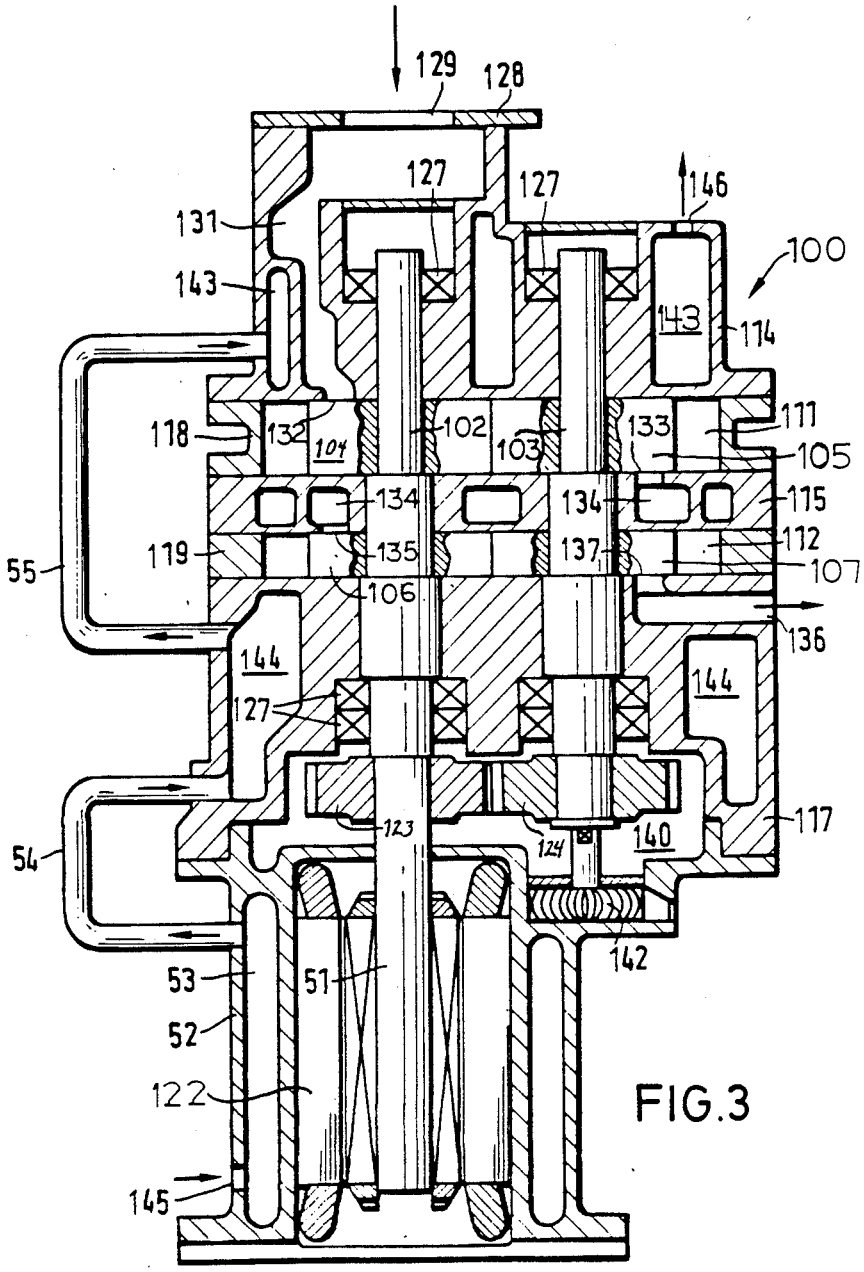
FIG. 3 is a longitudinal sectional view of a multistage pump according to another embodiment of the invention, and shows the pump housing and drive motor arranged axially in tandem.

FIG. 3 is a longitudinal sectional view of a two-stage twin-shaft vacuum pump 100 in accordance with another embodiment of the present invention. Pump 100 includes a housing formed by top channel member 114, housing ring 118, intermediate channel member 115, housing ring 119, and bottom channel member 117. Pump shafts 102 and 103 are rotatably mounted in this housing by bearings 127 in top channel member 114 and by bearing members 127 in bottom channel member 117. A pump chamber 111 is provided in housing ring 118, and rotors 104 and 105 are affixed respectively to shafts 102 and 103 in chamber 111. Similarly, a pump chamber 112 is provided in housing ring 119, and rotors 106 and 107 are affixed to shafts 102 and 103 respectively in pump chamber 112. Housing rings 118 and 119 are configured the same as shown for housing ring 18 in FIG. 2. Rotors 102 and 103 form a cooperating pair of pistons, and may be of the claw type shown for rotors 4 and 5 in FIG. 2 Rotors 106 and 107 also form a cooperating pair of pistons and may be of the claw type shown in FIG. 2.

A connecting flange 128 is affixed to the top of channel member 114. Flange 128 has an opening which provides an inlet 129 for pump 100. An inlet channel 131 communicates between pump inlet 129 and an inlet port 132 for pump chamber 111. The outlet port 133 of pump chamber 111 empties into a connecting chamber 134 in channel member 115, which in turn communicates with the inlet port 135 of pump chamber 112. The outlet port 137 of pump chamber 112 communicates with pump outlet 136.

With continuing reference to FIG. 3, a drive motor 122 is disposed below the pump. Motor 122 has a shaft 51 which is coaxial with shaft 102. Preferably, motor shaft 51 and pump shaft 102 are made from one piece. Motor 112 is water-cooled and is equipped for this purpose with a double-walled housing 52 which provides a cooling channel 53 between the walls. Furthermore, a cooling water inlet port 145 is provided in the outer wall of the motor housing. Water injected into inlet 145 flows through cooling channel 53 to a connecting line 54 and thence to a water channel 144 in bottom channel member 117. A further connecting line 55 carries the cooling water to a water channel 143 in top channel member 114, after which the water leaves pump 100 via an outlet 146.

Between drive motor 122 and lower channel member 117, there are disposed synchronization gears 123 and 124 and an oil chamber 140 into which extends oil pump 142. Oil pump 142 is coupled with drive shaft 103.

In spite of the pump housing and drive motor being arranged axially in tandem, vacuum pump 100 has a small structural height since the pump and motor have a common shaft, with motor shaft 51 and pump shaft 102 being a unitary element. Furthermore, since water is used as the cooling medium, the drive motor 112 does not require a cooling blower. A separate motor bearing may also be omitted. The cooling water inlet 145 is disposed as low as possible at motor housing 52 so that, in addition to being used as the cooling water inlet during operation of pump 100, inlet 145 can be used for drainage when desired and thereby ensure complete emptying of the entire cooling system.

Figure 4:
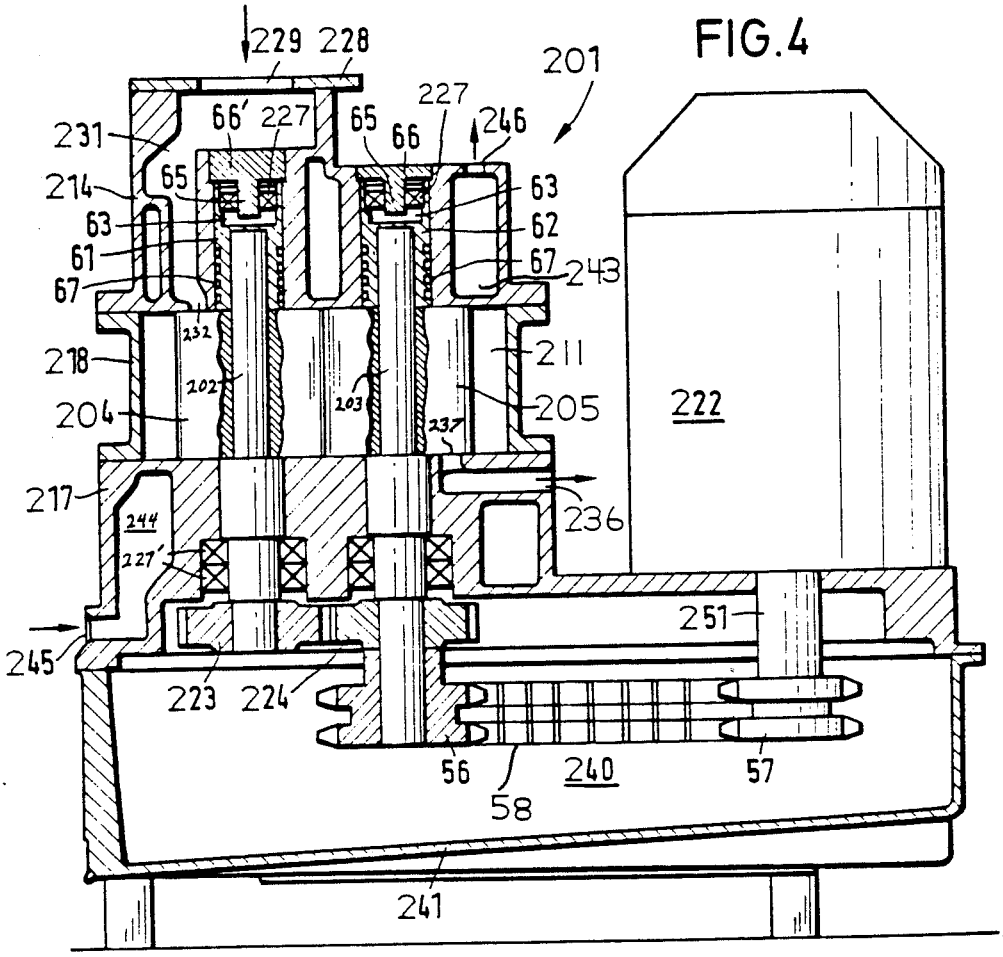
FIG. 4 is a longitudinal sectional view of a singlestage pump according to still another embodiment of the invention, which employs special bearings.

Turning next to FIG. 4, a single-stage twin-shaft vacuum pump 201 in accordance with yet another embodiment of the present invention has a housing which includes a top channel member 214, a housing ring 218, and a bottom channel member 217. Shafts 202 and 203 are rotatably mounted in this housing, as will be described in more detail below. Housing ring 218 provides a pump chamber 211. Cooperating rotors 204 and 205 are attached to shafts 202 and 203 respectively and are disposed in chamber 211.

A connecting flange 228 is attached to channel member 214, and has an opening which provides an inlet 229 for pump 201. Inlet 229 communicates via a channel 231 with an inlet port 232 to chamber 211. Furthermore, chamber 211 has an outlet port 237 which communicates with pump outlet 236.

Channel member 217 has a cooling water inlet 245 by which water is introduced into water channel 244 in channel member 217. From channel 244, the water flows through external tubing (not illustrated) to a water channel 243 in channel member 214. The water is expelled from pump 201 through cooling water outlet 246.

Pump 201 has a drive motor 222 arranged next to it. This arrangement has the advantage that a chain drive can be employed. For this purpose, a sprocket member 57 is attached to the shaft 251 of motor 222 and a sprocket member 56 is attached to shaft 203. Sprocket members 56 and 57 are disposed in an oil chamber 240 provided by trough member 241. Sprocket members 56 and 57 are connected together by means of a chain 58. The advantage of this arrangement is that changes in the number of revolutions (e.g. drive motors operating at 50 or 60 Hz) can be adjusted in a simple manner, by using sprocket members of the appropriate diameter. Moreover, drives of this type have the advantage of better damping. Instead of a chain drive, as shown, for transferring power from motor shaft 251 to pump shaft 203, it will be apparent that a belt drive or toothed-belt drive (not illustrated) could be employed.

FIG. 4 also shows an innovation relating to the configuration of the bearings for shafts 202 and 203 in channel member 214. The upper ends of shafts 202 and 203 are connected with essentially cylindrical socket members 61 and 62, which have cup-shaped openings 63 at their upper ends. (Alternatively, the shaft ends themselves, or the top ends of the rotors, may be given this cup-shaped openings 63). Housing covers 66 and 66' have cylindrical stumps 65 which project downward into cup-shaped openings 63. The inner bearing rings of bearings 227 are supported on stumps 65, and the outer bearing rings are supported on the inner walls of the socket members 61 and 62. Socket members 61 and 62 form gap seals with the walls of channel member 214 surrounding them. Each seal may be configured, for example, as a labyrinth seal 67 (with piston rings disposed in the grooves). This ensures effective separation of the bearing chambers from the pump chambers, which are usually oil free.

At their bottom ends, shafts 202 and 203 are rotatably supported by roller bearings 227' A gear 232 is affixed to shaft 202 and meshes with a gear 224 attached to shaft 203.

Figure 5:
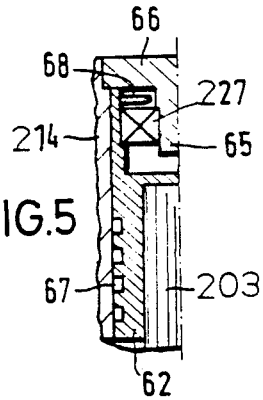
FIGS. 5 and 6 are sectional views showing suitable bearings for the upper ends of the pump shafts in the embodiment of FIG. 4.

FIG. 5 is an enlarged view of a bearing as used at the top end of shaft 203, for example. To prevent the escape of lubricants from the bearing chamber, a rotating ring 68 may be provided above bearing ring 227 so as to almost completely seal the bearing chamber from the exterior. Moreover, a centrifugal effect occurs. Lubricant reaching ring 68 is conveyed to the outside and thus back into the bearing chamber.

Figure 6:
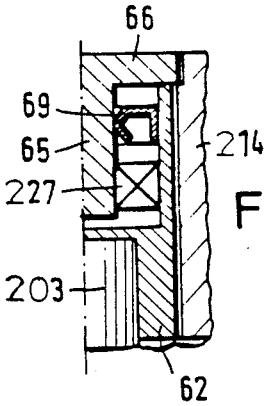

FIG. 6 illustrates an alternative bearing which can be used at the top ends of the shafts. A shaft sealing ring 69 is provided above bearing 227 to seal off the bearing chamber. If shaft 203 (for example) does not move, the sealing lip of shaft sealing ring 68 lies against stump 65. If the shaft rotates, this causes the sealing lip to lift off shaft stump 65 so that the seal becomes free of contact.

It will be understood that the above description of the present invention is susceptible to various modifications, changes and adaptations, and the same are intended to be comprehended within the meaning and range of equivalents of the appended claims.

What is claimed is:

1. A twin-shaft vacuum pump having a pump inlet and a pump outlet, comprising:

housing means for defining a pump chamber and a further chamber beneath the pump chamber, the pump inlet being disposed above the pump chamber and the pump outlet being disposed below the pump chamber, the housing means including an oil container disposed below the pump chamber, the further chamber extending into the oil container;

a horizontal connecting flange attached to the housing means, the horizontal connecting flange having an opening which provides the pump inlet;

a pair of pump shafts;

shaft mounting means for rotatably mounting the pump shafts so that the pump shafts are vertically disposed and extend into the pump chamber and into the further chamber;

a pair of claw-type Northey rotors in the pump chamber, each rotor being connected to a respective pump shaft;

a drive motor having a vertically disposed motor shaft;

power transmission means for connecting the motor shaft to one of the pump shafts, the power transmission means being disposed below the pump chamber;

synchronization means in the further chamber for synchronizing the rotation of the pump shafts, the synchronization means including two synchronization gears which are disposed below the pump chamber; and an oil pump projecting into the oil container, the oil pump being disposed at the lower end of one of the pump shafts.

2. The pump of claim 1, further comprising at least one additional pair of rotors, wherein the housing means further comprises means for defining at least one additional pump chamber disposed above the pump chamber, wherein the shafts extend through each at least one additional pump chamber, and wherein each at least one additional pair of rotors is disposed in a respective at least one additional pump chamber and attached to the shafts.

3. The pump of claim 2, wherein the pump inlet is disposed above the uppermost at least one additional pump chamber.

4. The pump of claim 1, wherein the synchronization gears are disposed side by side in a plane, and wherein the power transmission means comprises another gear attached to the motor shaft and a further gear meshing with the another gear and one of the synchronization gears, the another gear and further gear lying in the plane of the synchronization gears.

5. The pump of claim 1, wherein the power transmission means comprises an endless-loop member, the motor shaft and one of the pump shafts being encircled by the endless-loop member.

6. The pump of claim 5, wherein the endless-loop member is one of a chain, belt, and toothed belt.

7. The pump of claim 1, wherein the motor is mounted below the pump chamber.

8. The pump of claim 7, wherein the motor shaft is coaxial with one of the pump shafts.

9. The pump of claim 8, wherein the motor shaft and the coaxial pump shaft are a unitary element, the power transmission means being a portion of the unitary element.

10. The pump of claim 17, further comprising a continuous cooling system for circulating water to cool the motor and housing means.

11. The pump of claim 1, wherein the shaft mounting means comprises first cup means for providing a first cup-shaped cavity at the upper end of one of the pump shafts, the first cup-shaped cavity having an inner wall; a first stump; first stump-mounting means for mounting the first stump on the housing means so that the first stump extends into to first cup-shaped cavity; a first bearing which is supported on the inner wall of the first cup-shaped cavity and on the first stump; second cup means for providing a second cup-shaped cavity at the upper end of the other pump shaft, the second cup-shaped cavity having an inner wall; a second stump; second stump-mounting means for mounting the second stump on the housing means so that the second stump extends into the second cup-shaped cavity; and a second bearing which is supported on the inner wall of the second cup-shaped cavity and on the second stump.

12. The pump of claim 11, wherein the first cup means comprises a portion of said one of the pump shafts, the first cup-shaped cavity extending into said one of the pump shafts, and wherein the second cup means comprises a portion of said other pump shaft, the second cup-shaped cavity extending into said other pump shaft.

13. The pump of claim 11, wherein the first cup means comprises a first socket member having an exterior, the first socket member being mounted at the upper end of said one of the pump shafts, wherein the second cup means comprises a second socket member having an exterior, the second socket member being mounted at the upper end of said other pump shaft, and wherein the shaft mounting means further comprises first seal means for sealing the exterior of the first socket member to the housing means, and second seal means for sealing the exterior of the second socket member to the housing means.

14. The pump of claim 13, wherein the first seal means comprises one of a gap seal and a labyrinth seal and the second seal means comprises one of a gap seal and a labyrinth seal.

15. The pump of claim 11, wherein the shaft mounting means further comprises a first shaft sealing ring in the first cup-shaped cavity, and a second shaft sealing ring in the second cup-shaped cavity.

16. A twin-shaft vacuum pump having a pump inlet and a pump outlet, comprising:

housing means for defining a plurality of pump chambers disposed one above another, and a further chamber beneath the lowermost pump chamber, the pump inlet being disposed higher than the uppermost pump chamber and the pump outlet being disposed lower than the lowermost pump chamber, each pump chamber having a horizontally disposed lower floor with an outlet opening therein, the outlet opening in the lower floor of the lowermost pump chamber communicating with the pump outlet;

a pair of pump shafts;

shaft mounting means for rotatably mounting the pump shafts so that the pump shafts are vertically disposed and extend into the pump chambers and into the further chamber;

a plurality of pairs of rotors, each pair of rotors being disposed in a respective pump chamber and being attached to the shafts;

a drive motor having a motor shaft;

power transmission means for connecting the motor shaft to one of the pump shafts, the power transmission means being disposed below the pump chambers; and synchronization means in the further chamber for synchronizing the rotation of the pump shafts, the synchronization means including two synchronization gears which are disposed below the pump chambers.

17. The pump of claim 16, wherein the housing means further defines means for defining a coolant channel which extends along a path between a lower coolant opening and an upper coolant opening, the path having vertical and horizontal portions, the channel never descending, as it progresses from the lower coolant opening to the upper coolant opening, so that gravity urges coolant in the channel toward the lower coolant opening.

18. The pump of claim 16, further comprising a horizontal connecting flange connected to the housing means, the horizontal connecting flange being disposed directly over all of the pump chambers and having an opening which provides the pump inlet.

19. The pump of claim 16, wherein the rotors are claw-type Northey rotors, and further comprising an oil pump disposed in the further chamber and connected to one of the pump shafts.

* * * * *